US009054432B2

(12) United States Patent
Yang

(10) Patent No.: US 9,054,432 B2
(45) Date of Patent: Jun. 9, 2015

(54) TERMINAL PLATE SET AND ELECTRIC CONNECTOR INCLUDING THE SAME

(71) Applicant: ALL BEST PRECISION TECHNOLOGY CO., LTD., Taoyuan County (TW)

(72) Inventor: Haven Yang, New Taipei (TW)

(73) Assignee: ALL BEST PRECISION TECHNOLOGY CO., LTD., Taoyuan (TW)

( * ) Notice: Subject to any disclaimer, the term of this patent is extended or adjusted under 35 U.S.C. 154(b) by 51 days.

(21) Appl. No.: 14/044,292

(22) Filed: Oct. 2, 2013

(65) Prior Publication Data

US 2015/0093939 A1 Apr. 2, 2015

(51) Int. Cl.
*H01R 9/24* (2006.01)
*H01R 13/02* (2006.01)

(52) U.S. Cl.
CPC . *H01R 9/24* (2013.01); *H01R 13/02* (2013.01)

(58) Field of Classification Search
USPC ..... 439/626, 660, 638, 79, 607.18
See application file for complete search history.

(56) References Cited

U.S. PATENT DOCUMENTS

| | | | | |
|---|---|---|---|---|
| 5,993,259 | A * | 11/1999 | Stokoe et al. | 439/607.09 |
| 6,171,115 | B1 * | 1/2001 | Mickievicz et al. | 439/76.1 |
| 6,293,827 | B1 * | 9/2001 | Stokoe | 439/607.07 |
| 6,431,914 | B1 * | 8/2002 | Billman | 439/607.07 |
| 6,633,490 | B2 * | 10/2003 | Centola et al. | 361/785 |
| 6,638,079 | B1 * | 10/2003 | Billman et al. | 439/76.1 |
| 6,848,917 | B2 * | 2/2005 | Lang et al. | 439/79 |
| 6,884,117 | B2 * | 4/2005 | Korsunsky et al. | 439/607.11 |
| 6,969,280 | B2 * | 11/2005 | Chien et al. | 439/607.13 |
| 7,097,506 | B2 * | 8/2006 | Nakada | 439/607.39 |
| 7,175,446 | B2 * | 2/2007 | Bright et al. | 439/79 |
| 7,195,497 | B2 * | 3/2007 | Hull et al. | 439/79 |
| 7,195,519 | B1 * | 3/2007 | McAlonis et al. | 439/607.39 |
| 7,270,574 | B1 * | 9/2007 | Ngo | 439/607.39 |
| 7,320,621 | B2 * | 1/2008 | Laurx et al. | 439/607.11 |
| 7,347,740 | B2 * | 3/2008 | Minich | 439/736 |
| 7,651,337 | B2 * | 1/2010 | McNamara | 439/65 |
| 7,931,474 | B2 * | 4/2011 | Laurx et al. | 439/65 |
| 8,226,441 | B2 * | 7/2012 | Regnier et al. | 439/626 |
| 8,267,721 | B2 * | 9/2012 | Minich | 439/607.05 |
| 8,540,525 | B2 * | 9/2013 | Regnier et al. | 439/79 |
| 8,591,260 | B2 * | 11/2013 | Davis et al. | 439/607.55 |
| 8,616,919 | B2 * | 12/2013 | Stoner | 439/607.07 |
| 8,734,187 | B2 * | 5/2014 | De Geest et al. | 439/626 |
| 8,747,158 | B2 * | 6/2014 | Szczesny et al. | 439/607.07 |
| 2002/0168898 | A1 * | 11/2002 | Billman et al. | 439/608 |
| 2006/0068640 | A1 * | 3/2006 | Gailus | 439/608 |
| 2006/0189212 | A1 * | 8/2006 | Avery et al. | 439/608 |

* cited by examiner

*Primary Examiner* — Alexander Gilman
(74) *Attorney, Agent, or Firm* — WPAT, P.C.; Anthony King

(57) ABSTRACT

A terminal plate set and an electric connector including the terminal plate set are disclosed. The terminal plate set includes two signal terminal plates and two grounding terminal plates, and the signal terminal plates are parallel to each other and disposed between the grounding terminal plates. A partition channel is formed between the grounding terminal plates, between the signal terminal plates, between the signal terminal plate and the grounding terminal plate, or between the terminal plates. The electric connector includes the terminal plate set and a front body, and the terminal plate set is installed at the front body, and a front convection hole is formed on a plug side of the front body. The impedance of the signal terminal plates and the grounding terminal plates can be adjusted within the best range to improve the heat dissipation efficiency of the terminal plate set and the electric connector.

6 Claims, 12 Drawing Sheets

TERMINAL PLATE SET AND ELECTRIC CONNECTOR INCLUDING THE SAME

FIELD OF THE INVENTION

The present invention relates to a terminal plate set and an electric connector including the terminal plate set, in particular to the terminal plate set and the electric connector capable of adjusting the impedance of a signal terminal plate and a grounding terminal plate to the best range and improving the heat dissipation efficiency of the terminal plate set and the electric connector.

BACKGROUND OF THE INVENTION

In general, a computer and an electronic device come with various kinds of electric connectors for connecting the computer and the electronic device. The electric connector generally has two signal terminal plates installed between two grounding terminal plates. However, the signal terminal plates and the grounding terminal plates of the electric connector are arranged closely with each other, so that the effective dielectric coefficients of the signal terminal plates and the grounding terminal plates of the electric connector become relatively higher, and the electric connector has a greater power loss. Since the signal terminal plates and the grounding terminal plates of the electric connector are arranged closely with each other, air cannot flow easily between the signal terminal plates and the grounding terminal plates of the electric connector, and the heat generated by the signal terminal plates and the grounding terminal plates of the electric connector cannot be dissipated easily, and the heat dissipation efficiency of the electric connector is lowered.

Therefore, it is a main subject of the present invention to provide a terminal plate set and an electric connector including the terminal plate set, wherein the impedance of the signal terminal plates and the grounding terminal plates can be adjusted to the best range to improve the heat dissipation efficiency of the terminal plate set and the electric connector.

SUMMARY OF THE INVENTION

In view of the drawbacks of the prior art, the inventor of the present invention based on years of experience in the related industry to conduct extensive researches and experiments, and finally developed a terminal plate set and an electric connector including the terminal plate set, in hope of adjusting the impedance of the signal terminal plate and the grounding terminal plate to the best range and improving the heat dissipation efficiency of the terminal plate set and the electric connector.

To achieve the aforementioned and other objectives, a first mode of the present invention provides a terminal plate set comprising two signal terminal plates, and two grounding terminal plates, and the signal terminal plates are parallel to each other and disposed between the grounding terminal plates, and a partition channel is formed between the signal terminal plates, between the signal terminal plate and the grounding terminal plate, or between the terminal plates.

In the terminal plate set, at least one spacer plate is installed between the signal terminal plates, between the signal terminal plate and the grounding terminal plate, or between the terminal plates to form the partition channel.

The terminal plate set further comprises at least one spacing protrusion, and the spacing protrusion has a spacer plate and a positioning protrusion coupled to each other, and the spacer plate is installed between the signal terminal plates, between the signal terminal plate and the grounding terminal plate, or between the terminal plates to form the partition channel, and the positioning protrusion is plugged to the signal terminal plate or the grounding terminal plate.

In the terminal plate set, an upper spacer is installed between the upper edges of the signal terminal plates, between the upper edge of the signal terminal plate and the upper edge of the grounding terminal plate, or between the upper edges of the terminal plates, or a lower spacer is installed between the lower edges of the signal terminal plates, between the lower edge of the signal terminal plate and the lower edge of the grounding terminal plate, or between the lower edges of the terminal plates to form the partition channel.

In the terminal plate set, the partition channel has a width greater than 0.05 mm.

A second mode of the present invention is an electric connector including at least one terminal plate set of the first mode and a front body, wherein the terminal plate set is installed at the front body, and at least one front convection hole is formed on a plug side of the front body.

In the electric connector, the quantity and position of the front convection hole are corresponsive to those of the partition channel.

The electric connector further comprises a rear body, the front body and the terminal plate set installed at the rear body, and at least one rear convection hole is formed on a rear wall of the rear body.

In the electric connector, the quantity and position of the rear convection hole are corresponsive to those of the partition channel.

The terminal plate set and the electric connector of the present invention can adjust the impedance of the signal terminal plate and the grounding terminal plate to the best range and improve the heat dissipation efficiency of the terminal plate set and the electric connector.

DETAILED DESCRIPTION OF THE PREFERRED EMBODIMENTS

The objects, characteristics and effects of the present invention will become apparent with the detailed description of the preferred embodiments and the illustration of related drawings as follows.

Figure 1:
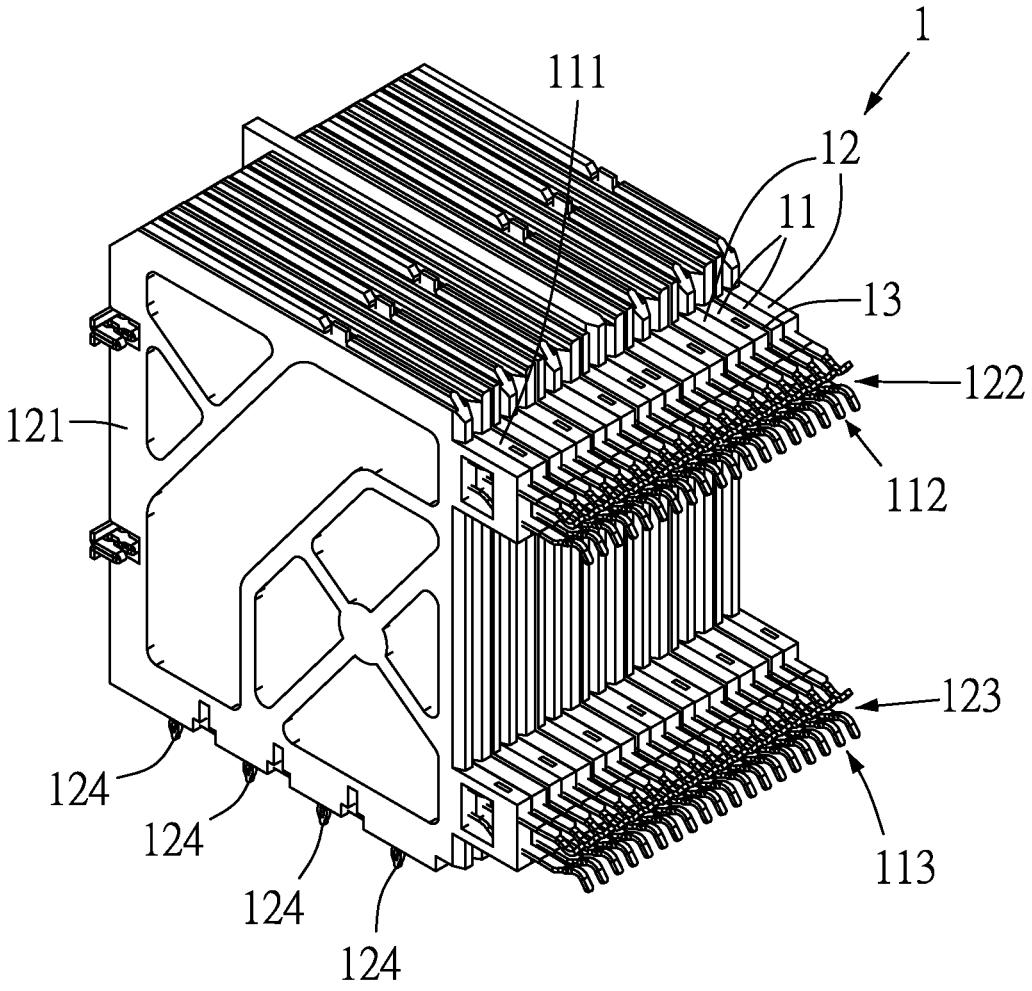
FIG. 1 is a first schematic view of a first preferred embodiment of the present invention.
Figure 2:
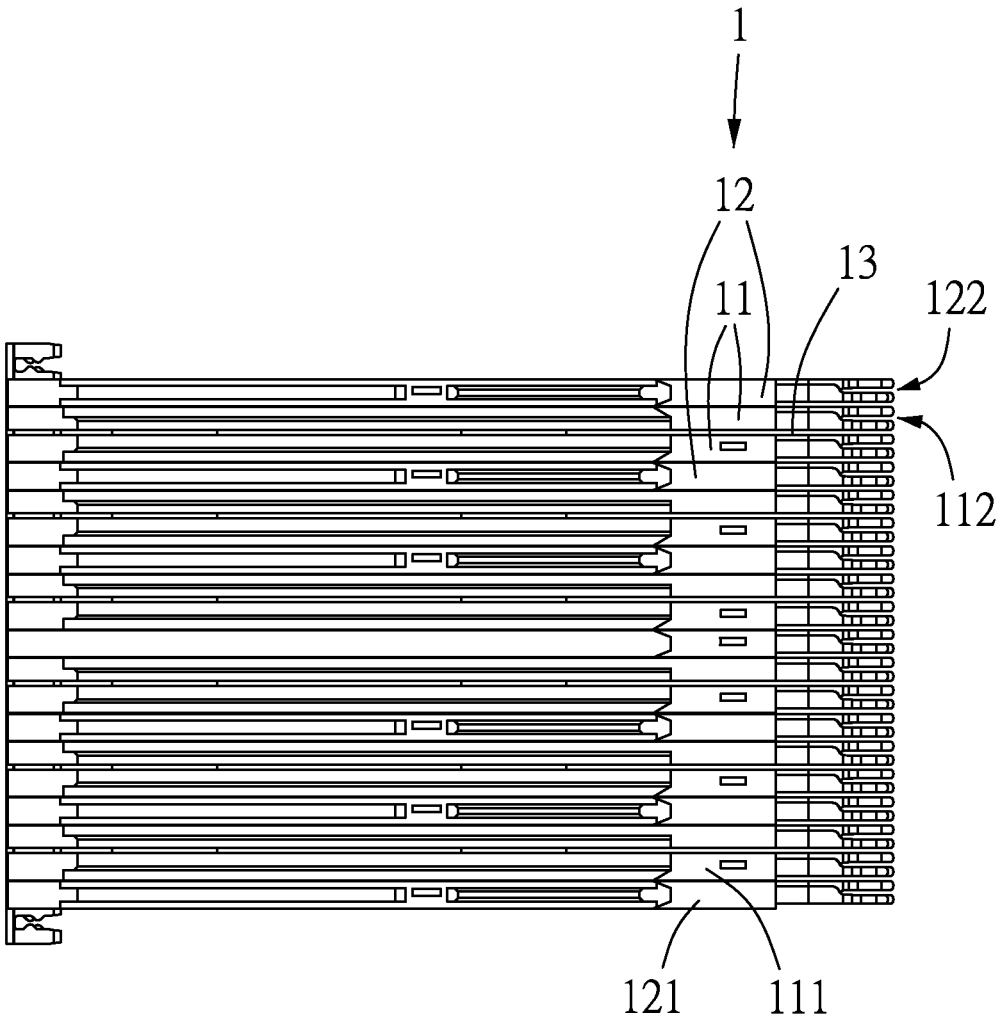
FIG. 2 is a second schematic view of the first preferred embodiment of the present invention.
Figure 3:
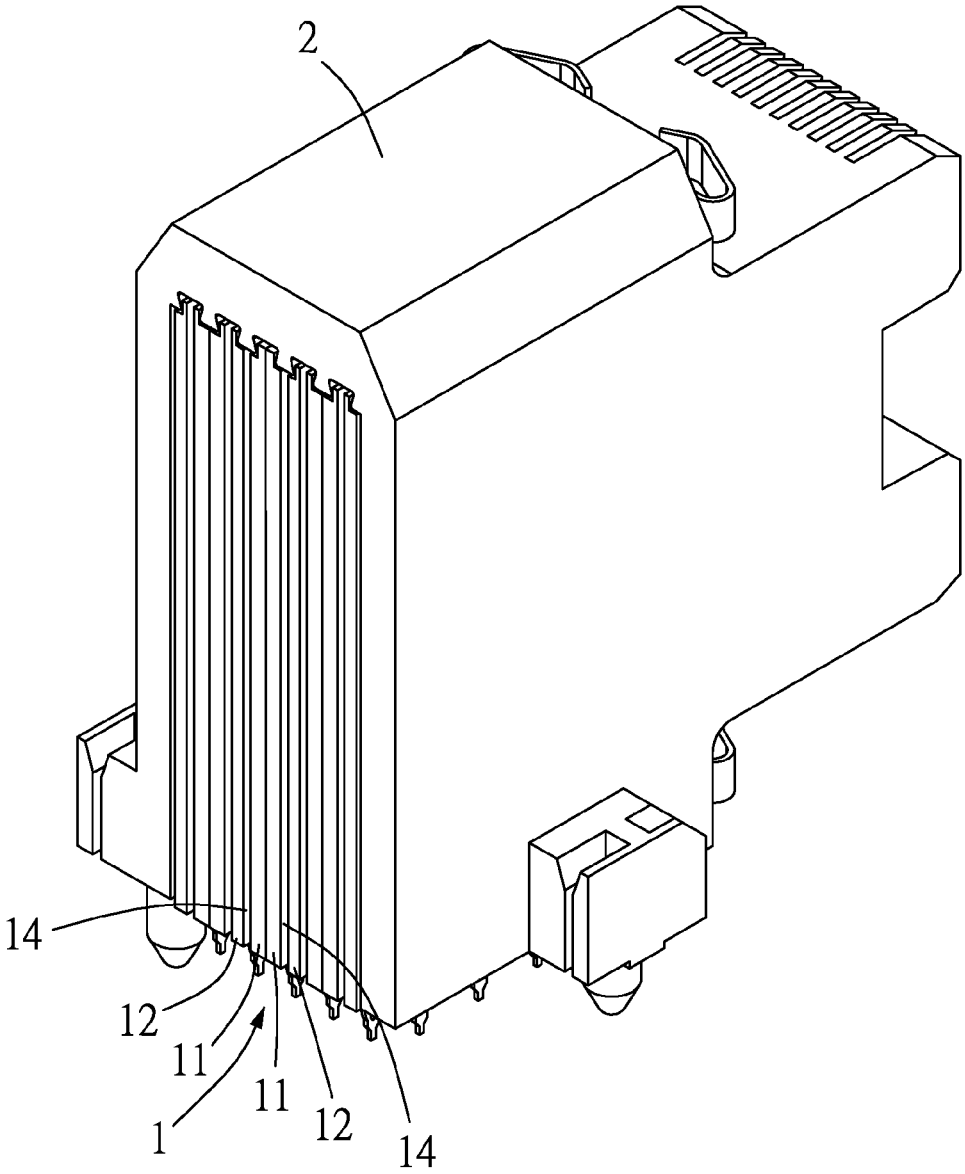
FIG. 3 is a third schematic view of the first preferred embodiment of the present invention.
Figure 4:
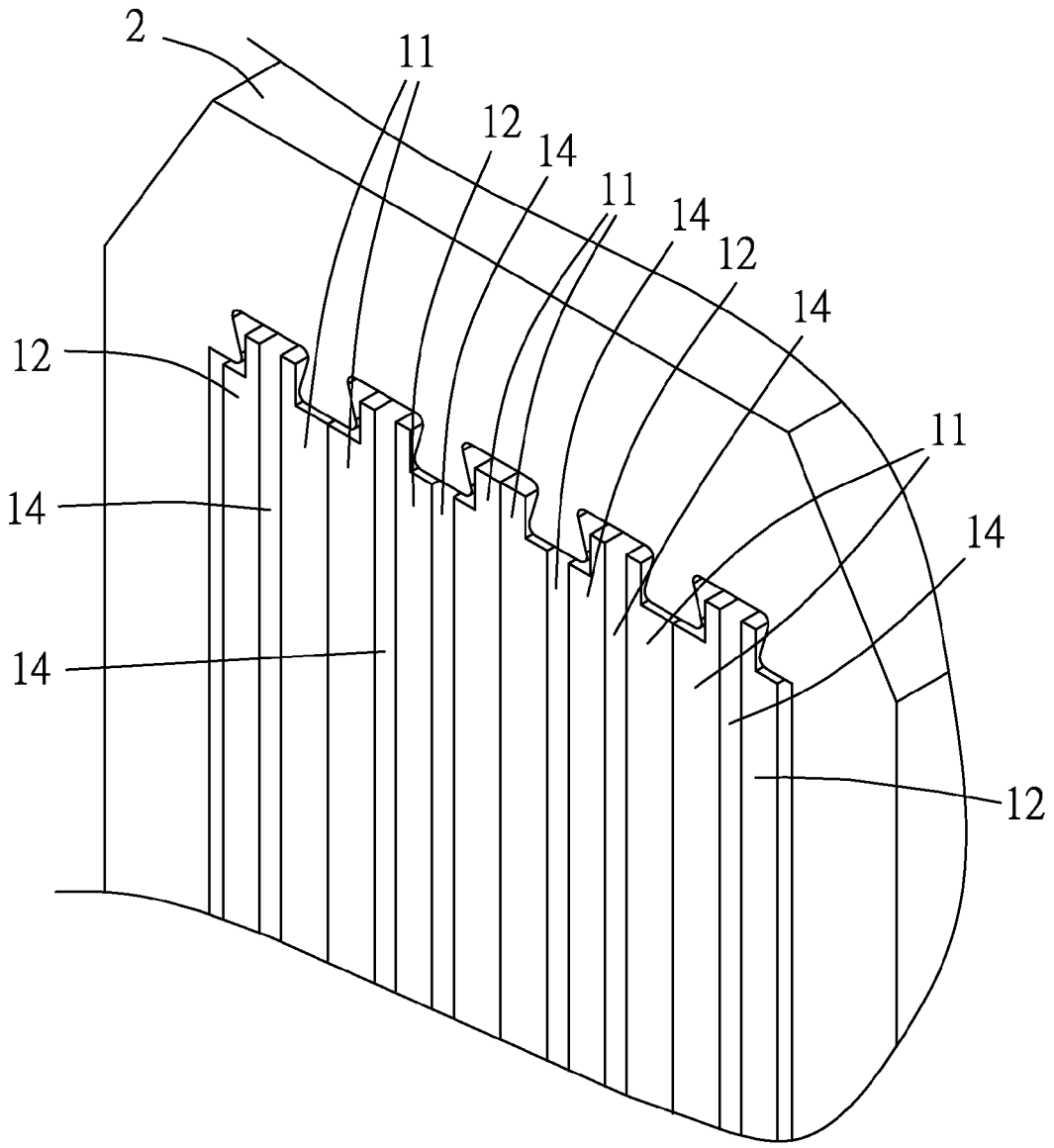
FIG. 4 is a fourth schematic view of the first preferred embodiment of the present invention.
Figure 5:
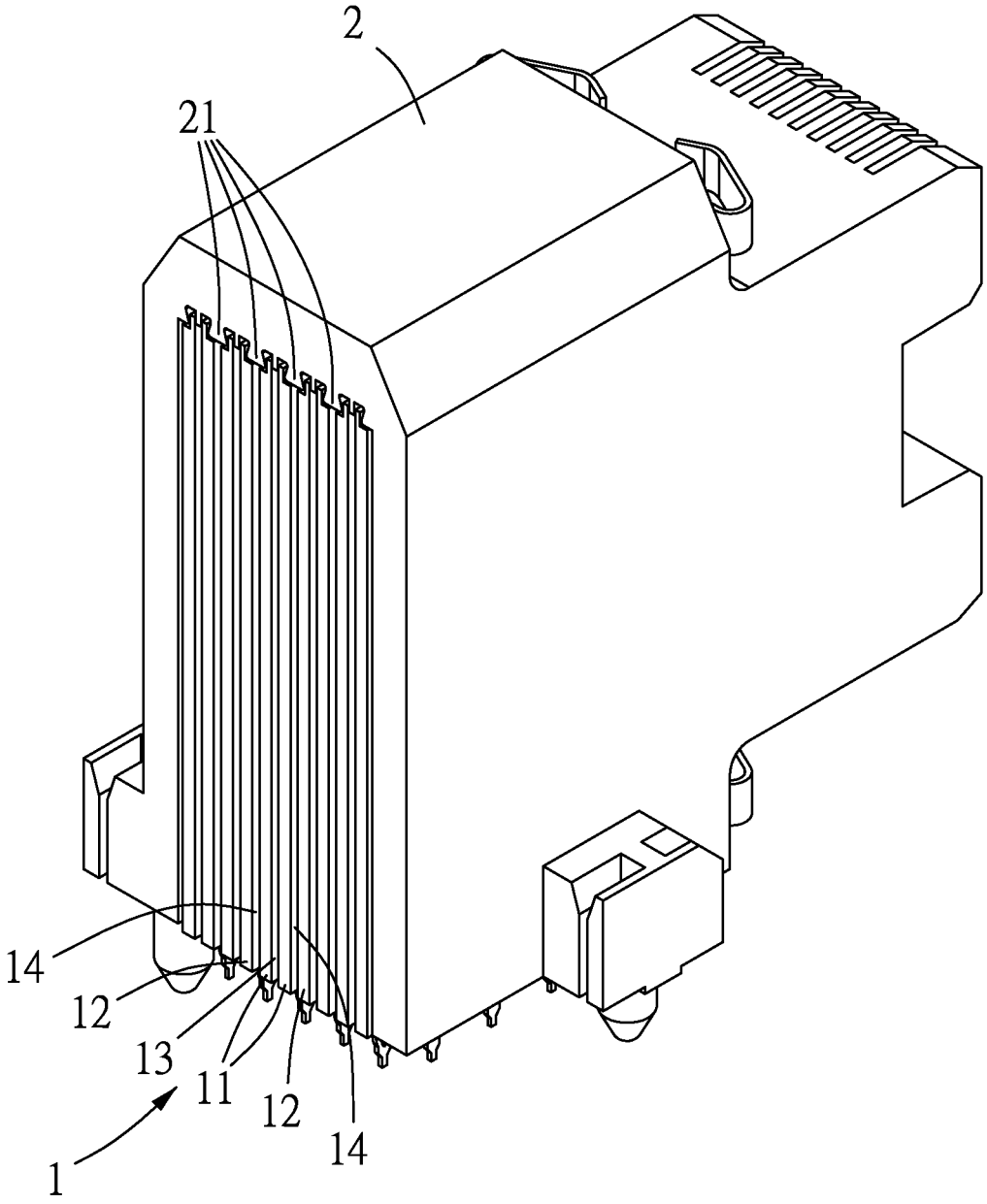
FIG. 5 is a fifth schematic view of the first preferred embodiment of the present invention.
Figure 6:
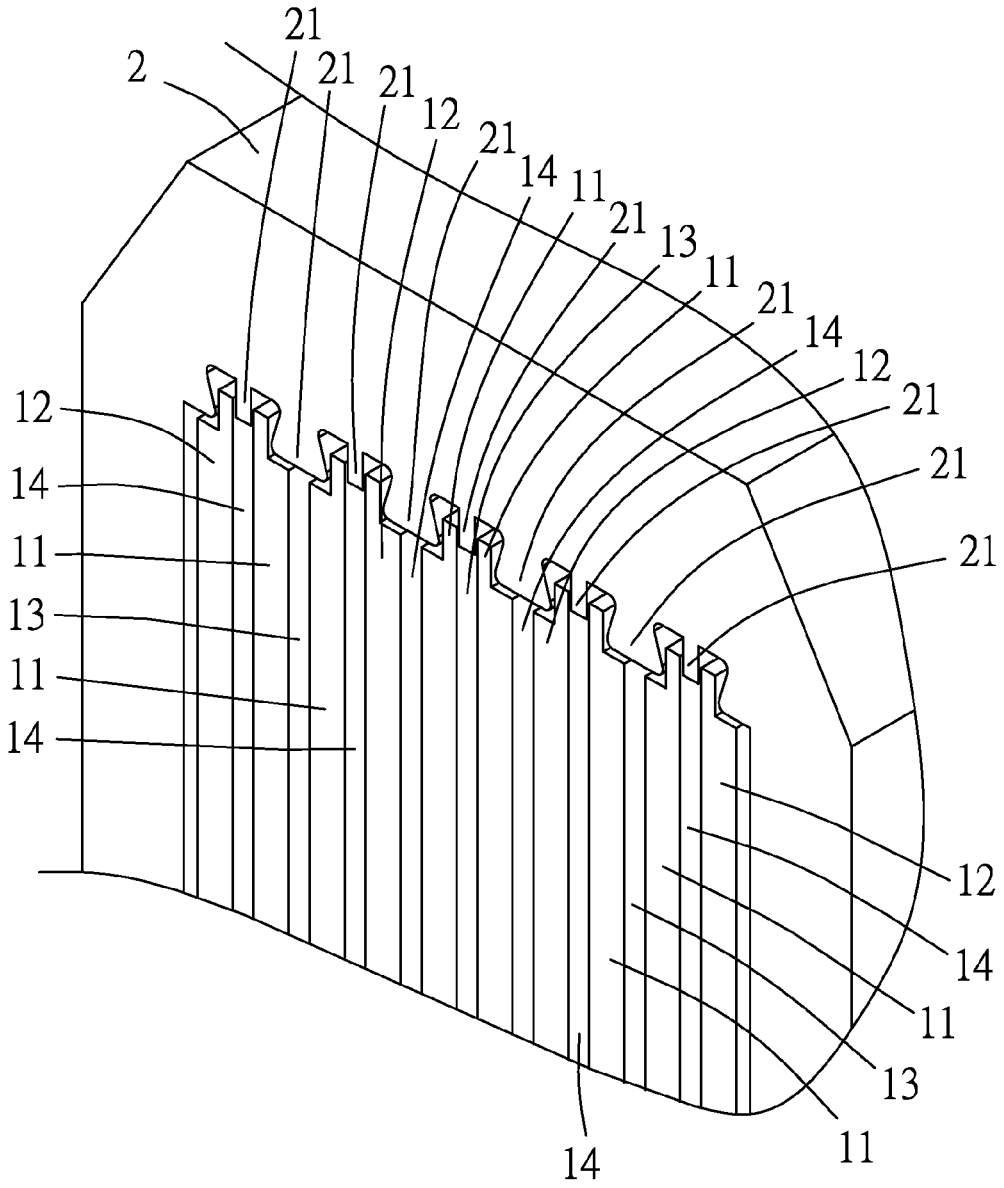
FIG. 6 is a sixth schematic view of the first preferred embodiment of the present invention.

With reference to FIGS. 1 to 7 for the schematic views of the first to sixth preferred embodiment of the present invention, and a schematic view of a spacer plate in accordance with the present invention respectively, a first mode of the invention comprises a terminal plate set 1 or a plurality of terminal plate sets 1 arranged parallel to one another. The terminal plate set 1 comprises two signal terminal plates 11 and two grounding terminal plates 12 as shown in FIG. 1, and the terminal plates 11, 12 have a conductive terminal (not shown in the figure) and a covering plate 111, 121 respectively, and the covering plates 111, 121 are covered onto the conductive terminals to prevent the conductive terminals from being short circuited by touching with each other and provide an effective insulation of the conductive terminals. An upper conductive flip pair 112, 122 and a lower conductive flip pair 113, 123 of the conductive terminal are exposed from the front side of the covering plate 111, 121, and four conductive pins 115, 124 of the conductive terminal are exposed from the bottom side of the covering plate 111, 121, and the conductive pins 115, 124 are corresponsive to the upper conductive flip pair 112, 122 and the lower conductive flip pair 113, 123 respectively. The upper conductive flip pair 112, 122 and the lower conductive flip pair 113, 123 are provided for connecting an external electronic device (not shown in the figure), and the conductive pins 115, 124 are soldered onto a circuit board (not shown in the figure). Wherein, the signal terminal plates 11 are parallel to each other and disposed between the grounding terminal plates 12, and a partition channel 13 is disposed between the signal terminal plates 11 as shown in FIGS. 1 and 2 (wherein FIG. 1 shows the top view), or a partition channel 14 is disposed between the signal terminal plate 11 and the grounding terminal plate 12 as shown in FIGS. 3 and 4 (wherein FIG. 3 shows a partial blow-up view), or a partition channel 13, 14 is disposed between the terminal plates 11, 12 as shown in FIGS. 5 and 6 (wherein FIG. 5 shows a partial blow-up view). When the terminal plates 11, 12 are arranged closely with each other, the partition channel 13, 14 can be formed between the signal terminal plates 11, between the signal terminal plate 11 and the grounding terminal plate 12, or between the signal terminal plates 11 and between the signal terminal plate 11 and the grounding terminal plate 12 at the same time. When the terminal plates 11, 12 are arranged closely with each other, the partition channel 13, 14 can be formed by reducing the thickness of the signal terminal plate 11, or reducing the thickness of the grounding terminal plate 12, or reducing the thickness of the signal terminal plate 11 and the thickness of the grounding terminal plate 12 at the same time.

The electric field generated by the conductive terminals in the partition channel 13, 14, the signal terminal plate 11 or the grounding terminal plate 12 can be passed through the partition channel 13, 14 (or the air in the partition channel 13, 14) to decrease the effective dielectric coefficient of the conductive terminal, so that the conductive terminals (of the signal terminal plate 11 or the grounding terminal plate 12) have the best range of impedance to reduce the power loss of the conductive terminals (of the signal terminal plate 11 or the grounding terminal plate 12).

Figure 7:
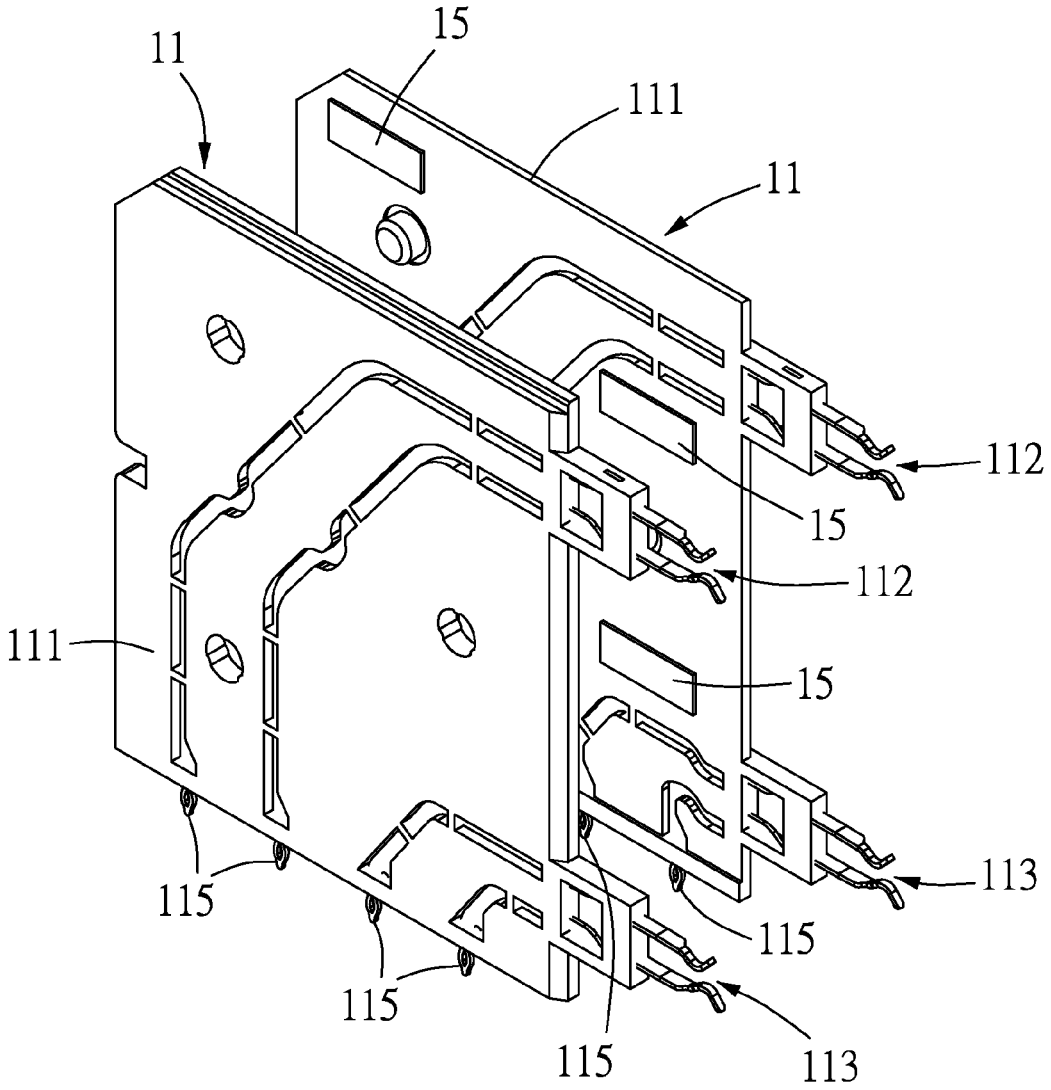
FIG. 7 is a schematic view of a spacer plate of the first preferred embodiment of the present invention.

In FIG. 7, at least one spacer plate 15 of the terminal plate set can be installed between the signal terminal plates 11, between the signal terminal plate 11 and the grounding terminal plate 12, or between the terminal plates 11, 12 to form the partition channel 13, 14.

Figure 8:
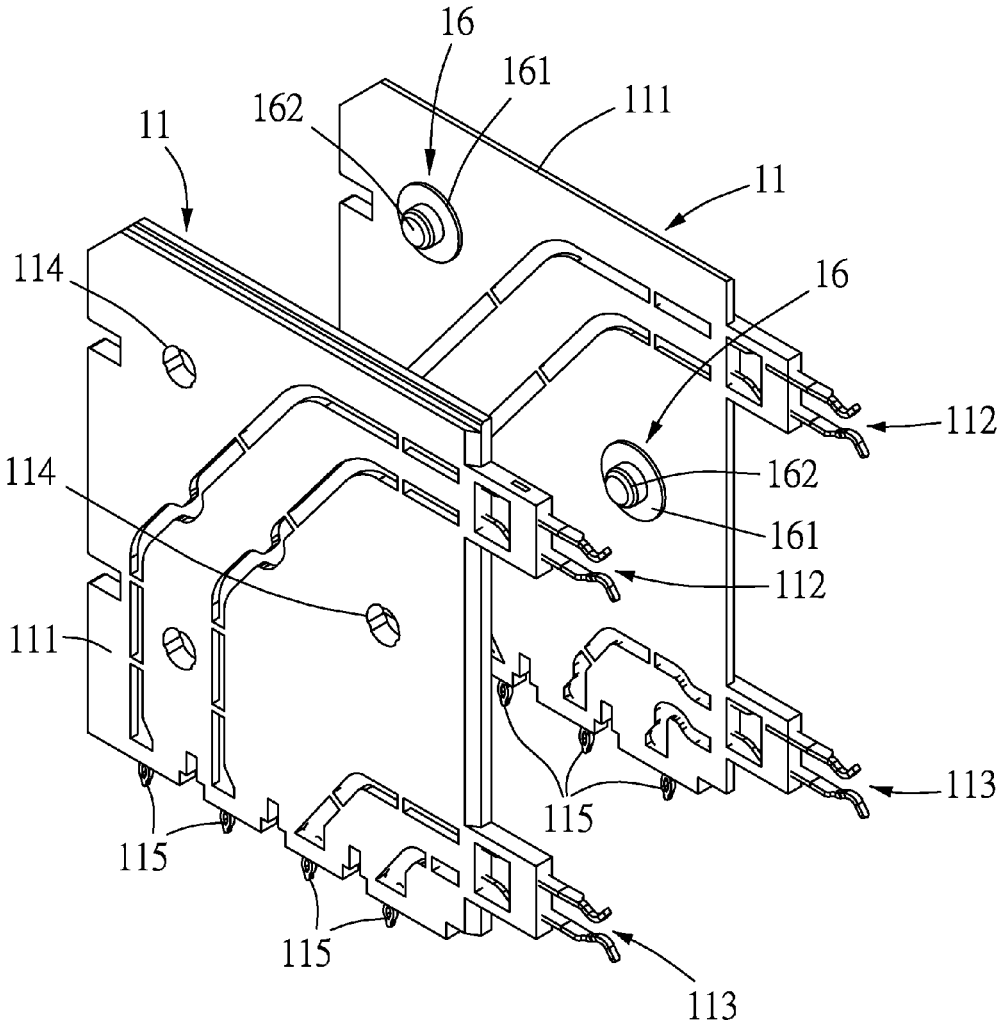
FIG. 8 is a schematic view of a spacing protrusion of the first preferred embodiment of the present invention.

With reference to FIG. 8 for a schematic view of a spacing protrusion of the first preferred embodiment of the present invention, the terminal plate set further comprises at least one spacing protrusion 16, and the spacing protrusion 16 has a spacer plate 161 and a positioning protrusion 162 coupled to each other. The spacer plate 161 can be installed between the signal terminal plates 11, between the signal terminal plate 11 and the grounding terminal plate 12, or between the terminal plates 11, 12 to form the partition channel 13, 14. The positioning protrusion 162 can be plugged into a penetrating hole 114 (or a concave hole) of the signal terminal plate 11 or the grounding terminal plate 12, and the positioning protrusion 162 is provided for fixing the signal terminal plates 11 at positions corresponding to each other, fixing the signal terminal plate 11 and the grounding terminal plate 12 at positions corresponding to each other, or fixing the terminal plates 11, 12 at positions corresponding to each other.

In FIG. 5, an upper spacer 21 of the terminal plate set can be installed between the upper edges of the signal terminal plates 11, between the upper edge of the signal terminal plate 11 and the upper edge of the grounding terminal plate 12, or between the upper edges of the terminal plates 11, 12 to form the partition channel 13, 14. In addition, a lower spacer (similar to the upper spacer, and not shown in the figure) can be installed between the lower edges of the signal terminal plates 11, between the lower edge of the signal terminal plate 11 and the lower edge of the grounding terminal plate 12, or between the lower edges of the terminal plates 11, 12 to form the partition channel 13, 14. The upper spacer 21 (or the lower spacer) can be a spacer block or strip installed at the top (or bottom) of an inner wall of the front body 2.

In the terminal plate set, the partition channel 13, 14 has a width greater than 0.05 mm.

Figure 9:
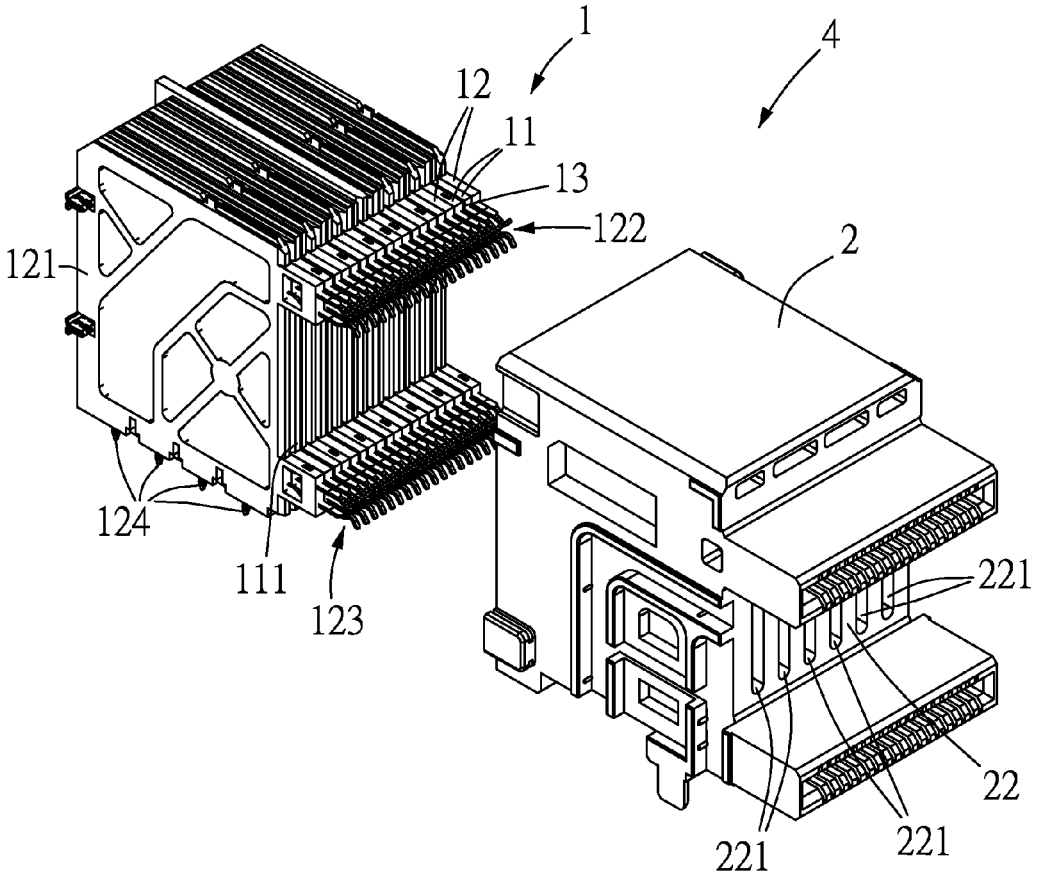
FIG. 9 is a schematic view of a terminal plate set and a front body of a second preferred embodiment of the present invention.

With reference to FIG. 9 for a schematic view of a terminal plate set and a front body of the second preferred embodiment of the present invention, a second mode of the present invention is an electric connector 4 comprising at least one of the terminal plate set 1 of the first mode and a front body 2, and the front body 2 can be made of plastic and the rear side and the bottom side of the front body 2 can have openings, and a plug side 22 of the front body 2 has at least one front convection hole 221, and the terminal plate set 1 can be installed into the front body 2 from the rear side of the front body 2.

By the partition channel 13, 14 and the front convection hole 221, outside air can flow from the front convection hole 221 through the partition channel 13, 14 to the rear side of the front body 2 to dissipate the waste heat generated by the terminal plate sets 1 and provide an effective heat dissipation of the signal terminal plate 11 or the grounding terminal plate 12 of the electric connector 4, so as to improve the heat dissipation efficiency of the electric connector 4.

Figure 10:
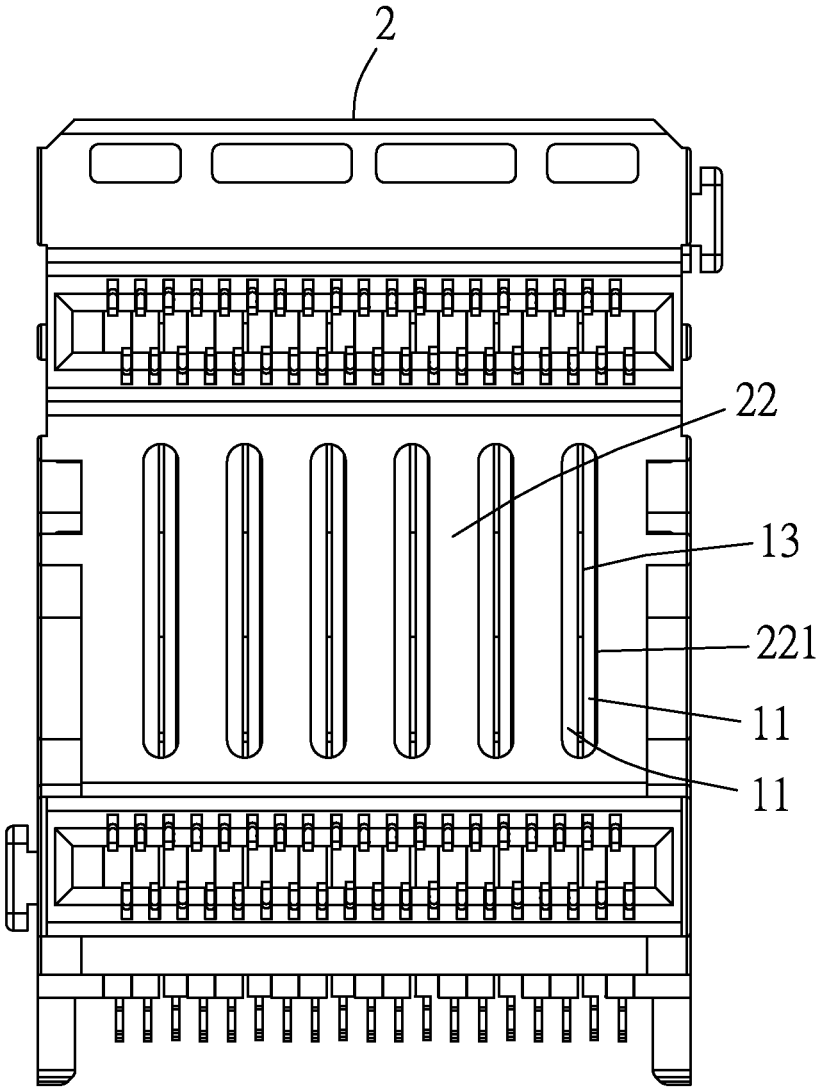
FIG. 10 is a schematic view of a front convection hole of the second preferred embodiment of the present invention.

With reference to FIG. 10 for a schematic view of a front convection hole of the second preferred embodiment of the present invention, the quantity and position of the front convection hole 221 of the electric connector are corresponsive to those of the partition channel 13, 14, so that air can flow smoothly to improve the heat dissipation efficiency of the electric connector 4.

Figure 11:
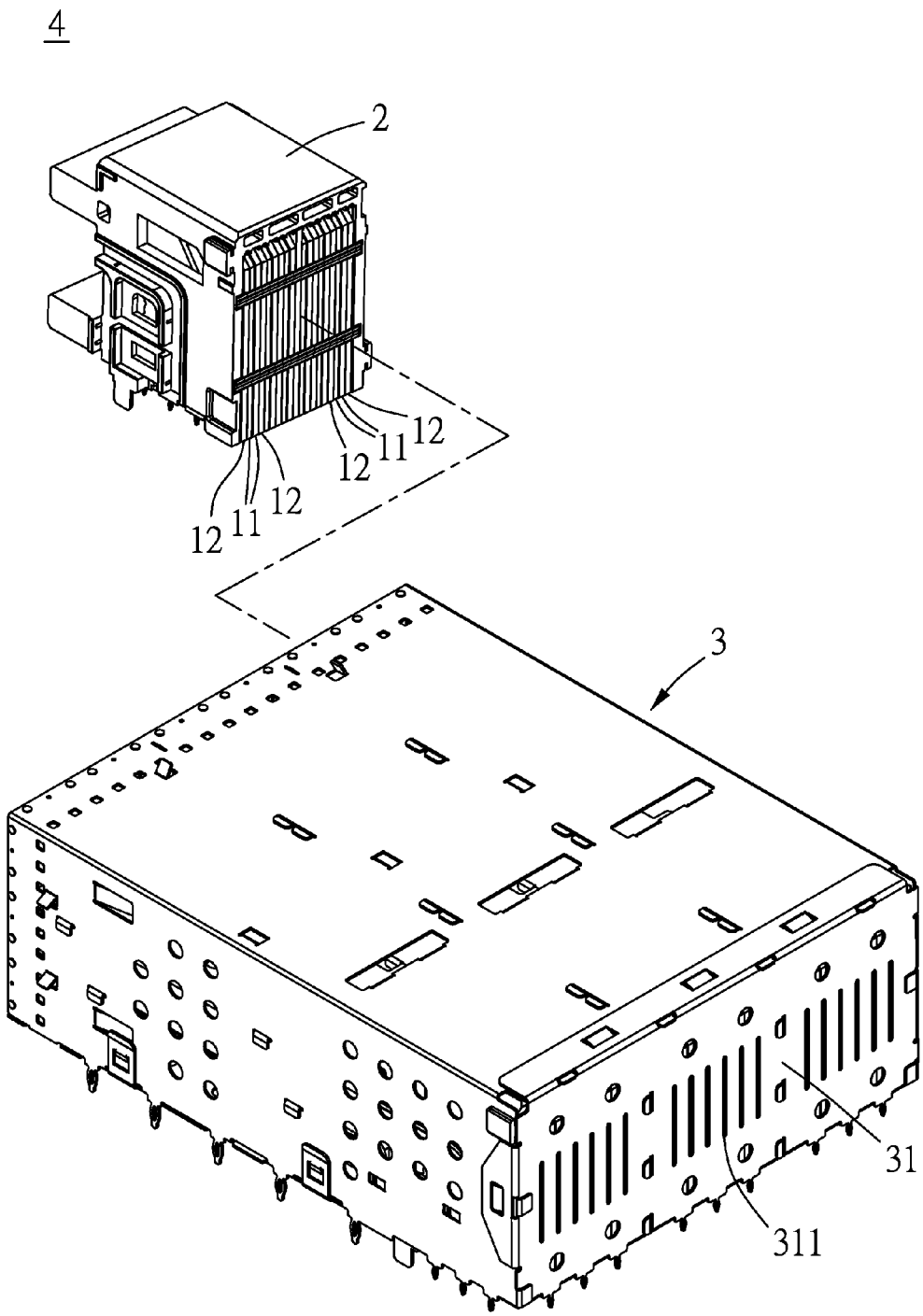
FIG. 11 is a schematic view of a terminal plate set, a front body and a rear body of the second preferred embodiment of the present invention.

With reference to FIG. 11 for a schematic view of a terminal plate set, a front body and a rear body of the second preferred embodiment of the present invention, the electric connector further includes a rear body 3, and the rear body 3 can be made of metal and whose front side and bottom side have openings, and at least one rear convection hole 311 is formed on a rear wall 31 of the rear body 3, and the front body 2 and the terminal plate set 1 can be installed into the rear body 3 from the front side of the rear body 3. By the partition channel 13, 14, the front convection hole 221 and the rear convection hole 311, outside air can pass from the front convection hole 221 into the rear convection hole 311 through the partition channel 13, 14 to dissipate the waste heat generated by the terminal plate sets 1, so that the signal terminal plate 11 or the grounding terminal plate 12 of the electric connector 4 provides an effective cooling effect to improve the heat dissipation efficiency of the electric connector 4.

Figure 12:
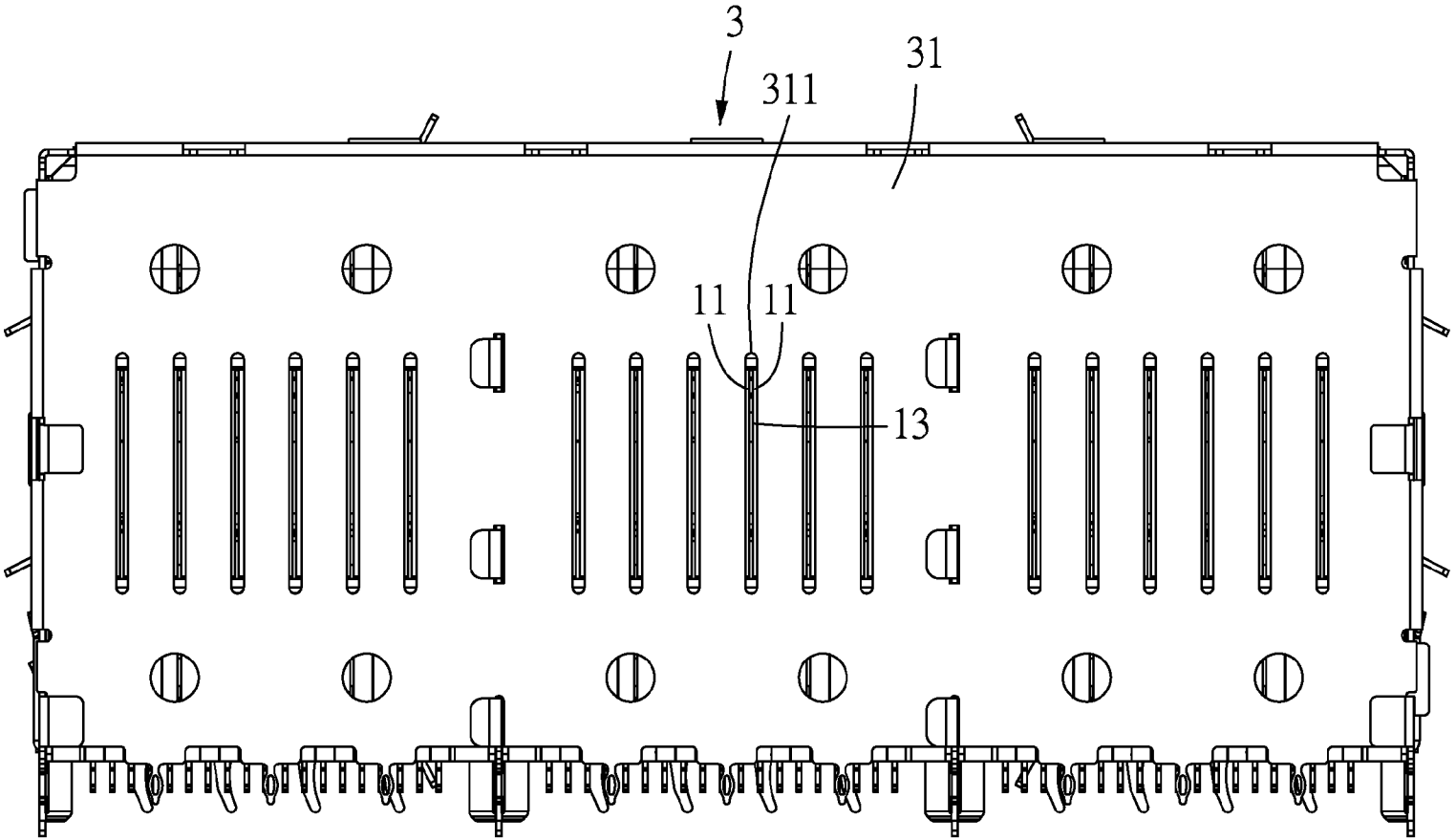
FIG. 12 is a schematic view of a rear convection hole of the second preferred embodiment of the present invention.

With reference to FIG. 12 for a schematic view of a rear convection hole of the second preferred embodiment of the present invention, the quantity and position of the rear convection hole 311 of the electric connector are corresponsive to those of the partition channel 13, 14, so that air can flow smoothly to further improve the heat dissipation efficiency of the electric connector 4.

While the invention has been described by means of specific embodiments, numerous modifications and variations could be made thereto by those skilled in the art without departing from the scope and spirit of the invention set forth in the claims.

What is claimed is:

1. A terminal plate set, comprising:

two signal terminal plates;

two grounding terminal plates, wherein the signal terminal plates and the grounding terminal plates are parallel to each other and the signal terminal plates are disposed between the grounding terminal plates, and a partition channel is disposed between the signal terminal plates, between the signal terminal plate and the grounding terminal plate, or between the signal terminal plates and the grounding terminal plates; and at least one spacing protrusion, having a spacer plate and a positioning protrusion coupled to each other, and the spacer plate being installed between the signal terminal plates, between the signal terminal plate and the grounding terminal plate, or between the signal terminal plates and the grounding terminal plates to form the partition channel, and the positioning protrusion being inserted into the signal terminal plate or the grounding terminal plate.

2. The terminal plate set of claim 1, further comprising an upper spacer disposed between the upper edges of the signal terminal plates, between the upper edge of the signal terminal plate and the upper edge of the grounding terminal plate, or between the upper edges of the signal terminal plates and the grounding terminal plates, or a lower spacer disposed between the lower edges of the signal terminal plates, between the lower edge of the signal terminal plate and the lower edge of the grounding terminal plate, or between the lower edges of the signal terminal plates and the grounding terminal plates to form the partition channel.

3. The terminal plate set of claim 1, wherein the partition channel has a width greater than 0.05 mm.

4. An electric connector, including at least one terminal plate set and a front body, and the terminal plate set being installed at the front body, and at least one front convection hole being formed on a plug surface of the front body;

wherein the terminal plate set comprises two signal terminal plates and two grounding terminal plates, the signal terminal plates and the grounding terminal plates are parallel to each other and the signal terminal plates are disposed between the grounding terminal plates, and a partition channel is disposed between the signal terminal plates, between the signal terminal plate and the grounding terminal plate, or between the signal terminal plates and the grounding terminal plates, and the quantity and position of the front convection hole correspond to those of the partition channel.

5. The electric connector of claim 4, further comprising a rear body, and the front body and the terminal plate set being disposed at the rear body, and at least one rear convection hole being formed on a rear wall of the rear body.

6. The electric connector of claim 5, wherein the quantity and position of the rear convection holes are corresponsive to the quantity and position of the partition channels.

* * * * *